US005668328A

United States Patent [19]

Steber et al.

[11] Patent Number: 5,668,328

[45] Date of Patent: Sep. 16, 1997

[54] METHOD AND APPARATUS FOR HYDRAULICALLY TIGHTENING THREADED FASTENERS

[75] Inventors: George R. Steber, Mequon; Dale A. Knutson, Nashotah; Douglas P. Miller, New Berlin, all of Wis.

[73] Assignee: Applied Power Inc., Butler, Wis.

[21] Appl. No.: 682,209

[22] Filed: Jul. 17, 1996

[51] Int. Cl.[6] ..... B25B 21/00

[52] U.S. Cl. ..... 73/862.23

[58] Field of Search ..... 73/862.23, 862.24, 73/862.25, 761

[56] References Cited

U.S. PATENT DOCUMENTS

| | | | |
|---|---|---|---|
| 4,104,778 | 8/1978 | Vliet . | |
| 4,106,176 | 8/1978 | Rice et al. . | |
| 4,137,800 | 2/1979 | Austin . | |
| 4,361,945 | 12/1982 | Eshghy . | |
| 4,768,388 | 9/1988 | Fader et al. | 73/862.23 |
| 4,791,838 | 12/1988 | Bickford et al. . | |
| 4,823,616 | 4/1989 | Tabmini | 73/862.25 |
| 4,864,903 | 9/1989 | Bickford et al. . | |
| 4,941,362 | 7/1990 | Tambini | 73/862.23 |
| 4,961,035 | 10/1990 | Inaba et al. . | |
| 5,315,501 | 5/1994 | Whitehouse | 73/862.23 |

*Primary Examiner*—Thomas P. Noland
*Assistant Examiner*—Ronald Biegel
*Attorney, Agent, or Firm*—Quarles & Brady

[57] ABSTRACT

A system for tightening a threaded fastener with a hydraulic wrench has a pumping unit which measures parameters representative of the torque applied to the fastener and the angle of advance of the fastener, remote from the wrench. The pump measures pressure as a parameter representative of torque and measures flow rate, pump speed (for a fixed displacement pump), or time (for a fixed displacement pump driven at constant speed) as a parameter representative of the angle of advance of the fastener. A ratchet-type hydraulic wrench is used, and the pressure versus angle data produced in tightening a fastener is manipulated to discard irrelevant portions and smooth relevant portions to provide data representative of torque and angle during the tightening process from which to determine a final stopping parameter for terminating tightening. The system also has a calibration fixture for determining the volumetric rate of angle advance for a given wrench. Any tightening methodology dependent upon angle may be used to practice the invention, or the invention may be applied to monitor the tightening process.

13 Claims, 4 Drawing Sheets

METHOD AND APPARATUS FOR HYDRAULICALLY TIGHTENING THREADED FASTENERS

BACKGROUND OF THE INVENTION

1. Field of the Invention

This invention relates to a method and apparatus for tightening threaded fasteners using a hydraulic torque wrench based on determinations of parameters representative of torque and angle of a threaded fastener.

2. Discussion of the Prior Art

Threaded fasteners (hereinafter referred to as 'fasteners'), such as a bolt and nut, a bolt threaded into a bore, or a nut threaded onto a stud or shank, are commonly used to connect two or more members into a solid rigid structure or joint. It is highly desirable that the components of the rigid structure remain in the tightened state at all times, and especially when external loadings such as vibration, shock and static or dynamic forces are applied to them.

To achieve a reliable joint in critical applications, it is important that the correct clamping force be applied by the fastener to the joint. This is to say, the tension in the bolt must achieve a certain value for the joint to be properly clamped. If the bolt tension is too low, it may loosen and cause all clamp force to be removed with attendant damage to the structure. If it is too high, the fastener or clamped parts could fail, also causing damage to the structure.

There are no known methods for measuring bolt tension directly without instrumenting the fastener and/or joint. Instrumenting a joint is expensive and time consuming and therefore seldom done in mass production. Sophisticated inferential methods have therefore been developed to estimate the bolt tension based on known or estimated parameters of the bolted system such as the torque applied to the fastener by the tightening system and/or the angle of advance of the fastener. Such methods include terminating tightening when a certain torque value is reached, a certain angle of advance is reached as measured from a defined point, when the yield point of the joint has been reached and others.

The types of methods used have to some extent been dependent on the types of tools used for tightening the joint. Methods in which tightening was terminated based on both measured torque and angle values have typically required instrumenting the tool to acquire both types of data values. These methods have usually been used with electrically or pneumatically driven tools, where they are practical.

In rugged or very heavy duty applications, where hydraulic torque wrenches are typically used, it is not possible, or at best highly undesirable, to instrument the tools. In such applications, the joint has typically been tightened by terminating tightening in response to reaching a certain torque. This avoids the need to instrument the tool because the torque can be determined from the pressure applied to the wrench. The pressure is a parameter which is representative of the torque applied to the fastener, and can be measured remotely from the wrench, typically at the pump which supplies fluid to the wrench. The pump may include a controller for terminating the flow of fluid to the wrench when the pressure corresponding to the desired torque value is reached.

Another difference between hydraulic and pneumatic or electric wrenches lies in their basic operation. Pneumatic and electric wrenches typically can rotate the fastener during tightening for 360° or much more without stopping, until the desired stopping point is reached. Hydraulic wrenches, on the other hand, are usually operated by a reciprocating hydraulic piston/cylinder device operating through a ratcheting mechanism to turn a socket for the fastener a fixed number of degrees, e.g., 32°, each full advance of the piston. Advance of the fastener, and therefore advance of the associated angle and torque, are in stages, with the advance starting and stopping several times in the course of tightening a single fastener, until the final stopping parameter, typically a final pressure, is reached.

Thus, in operation a hydraulic torque wrench socket driver will turn for a certain number of degrees while applying torque to the fastener until it reaches its limit of advance or until the final pressure is reached. If the stroke reaches its limit before the final pressure is reached, the operator of the wrench trips a switch which operates a valve to dump the wrench pressure to tank, allowing the wrench to return to its starting point, by ratcheting around the socket. During the resetting of the wrench, the driven socket of the wrench does not rotate but may recede a small amount due to clearance between the socket and the head of the threaded fastener.

Thus, as the torque wrench tightens the fastener, there is generated a time sequence of torque pulses, each covering a limited angle (e.g., 32°), which causes the fastener to rotate and therefore become tensioned. The space between the torque pulses, when the dump valve is open, is used for resetting the socket driver. The result of this complex operation is that there is a rather severe discontinuous functional relationship between the torque, pressure or other force dependent variables of the system with respect to the angle of advance of the fastener. This exacerbates the problem of applying known fastener tightening methods to the operation of a hydraulic torque wrench.

In the past, the output of hydraulic torque wrenches has been largely controlled by monitoring and regulating the magnitude of applied hydraulic pressure. It is well known in the art of threaded fasteners that because of variations in the coefficients of friction at the threaded engagement and at other sliding surfaces, the tension level (i.e., the clamping force) achieved at a given pressure (torque) level can vary as much as 30%. More sophisticated tightening methodologies are known, such as the "turn-of-the-nut" method disclosed in U.S. Pat. No. 4,106,176, which yield a more accurate clamping force, but require the measurement of angle as well as torque, and have not found practical application in fastener tightening by torque wrenches.

SUMMARY OF THE INVENTION

This invention provides a method and apparatus for precisely controlling a hydraulic torque wrench fastener tightening system. In so doing, data representative of the torque and angle of turn of the fastener is obtained, which can be used to monitor the tightening of the fastener or determine a final stopping point for terminating tightening. The invention accomplishes this without adding any attachments to the hydraulic torque wrench.

In one aspect, pressure is measured and processed into a parameter representative of torque and an angle parameter representative of the angle of rotation of the fastener by the wrench is determined from a measurement of the volume of fluid supplied to the wrench. The angle parameter may be flow rate integrated over time, pump speed integrated over time if a fixed displacement pump is used to supply the wrench, time if a fixed displacement pump driven at constant speed is used to supply the wrench, or any other value representative of flow supplied to the wrench. All of these values can be directly or indirectly measured without instrumenting or otherwise altering the wrench.

The wrench may be of the common type driven by a reciprocating piston and cylinder device through a ratchet drive mechanism. If so, the torque and associated angle data points define a function which in graphical form of associated pressure and angle is defined in part by a series of spikes separated by ramps and angle advances. Each spike begins at a first pressure which occurs just prior to the wrench reaching a limit of advance and has a maxima and minima. Each ramp begins at the spike minima of the previous spike and continues to a second pressure approximately equal to the first pressure. Each corresponding angle advance, which is the set of data points which results from turning the fastener, begins at the second pressure and continues to the first pressure of the succeeding spike. The data points of the spike and of the ramp are discarded, and the data points of the angle advances are smoothed to create a characteristic function of parameters representative of torque and angle for the joint.

The invention can be practiced with a single acting or a double acting torque wrench, the signal processing being somewhat different depending on which type of wrench is used. In addition, the system may be provided with a calibration fixture to determine the volumetric rate of angle advance and the pressure vs. torque relationship for a given wrench.

These and other objects and advantages of the invention will be apparent from the detailed description and drawings.

DETAILED DESCRIPTION OF THE PREFERRED EMBODIMENTS

Figure 1:
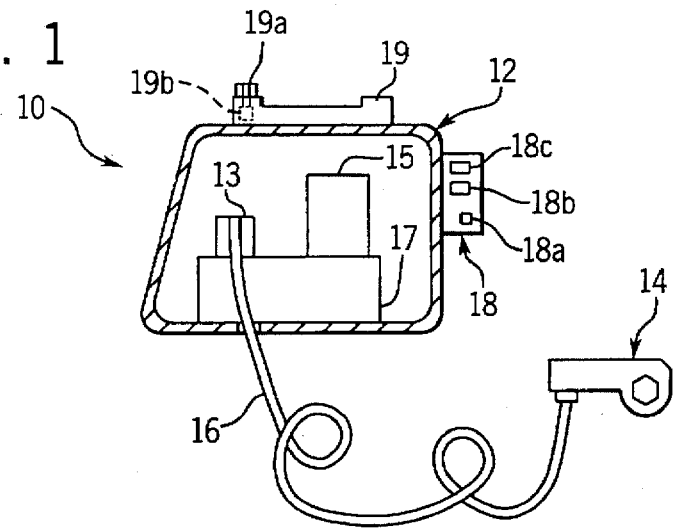
FIG. 1 is a plan view of a hydraulic fastener tightening system of the invention.

FIG. 1 illustrates a system 10 of the invention which includes a pumping unit 12, a hydraulic wrench 14 and a hydraulic line 16 connecting the unit 12 to the wrench 14 for supplying pressurized hydraulic fluid to the wrench 14 and returning the fluid from the wrench 14 to the pumping unit 12.

Figure 2:
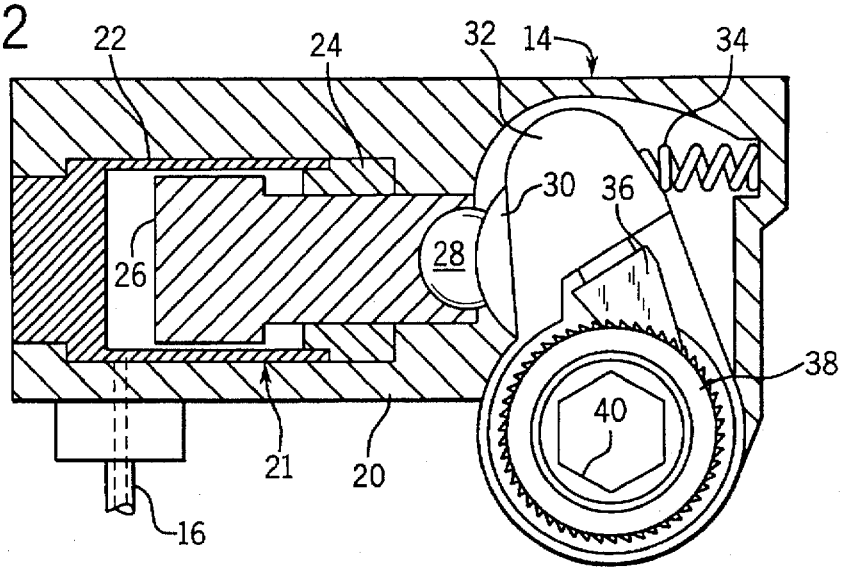
FIG. 2 is a cross-sectional view of a prior art wrench of the type illustrated in FIG. 1.

The wrench 14 may be of any suitable type. One such type is shown in FIG. 2, which is of a prior art design. The wrench 14 is designed for extremely rugged and heavy duty service, having a solid steel body 20 which houses a sleeve 22 and plug 24 which define a hydraulic cylinder 21 within the body 20. Piston 26 is slidably received in the cylinder 21 to reciprocate axially as hydraulic fluid is introduced to the cylinder 21 at the left end of piston 26 (as viewed in FIG. 2) and relieved therefrom via line 16.

At its rightward end, the piston 26 has a ball and socket joint in which ball 28 is slidably received, which slidably mates with crown 30 of lever 32. Piston 26 is returned to its retracted position by compression spring 34. A fine-toothed spline drive ratchet pawl 36 engages teeth on the outside of quill shaft 38, which is journaled in body 20, to rotate the quill shaft 38 clockwise as viewed in FIG. 2. On the return stroke, the ratchet pawl 36 chatters in reverse over the teeth of shaft 38 under the bias of spring 34, in well known manner. Quill shaft 38 drives a socket 40 (which may be removable and replaceable, as is well-known) which engages a head of a fastener to rotate and tighten the fastener.

The unit 12 also includes a controller 18 and an automatic calibration station 19. The unit 12 has a fixed displacement pump 13 driven by a prime mover 15 (such as an electric motor) through appropriate mechanism (not shown, e.g., a suitable drive mechanism such as a belt and pulley arrangement, chain and sprocket arrangement, gear arrangement etc.) housed within the housing 17. The pump 13 may also be a two stage pump, with one stage being a low pressure variable displacement pump (e.g., a gerotor type pump) and the second stage being a fixed displacement pump (e.g., a piston type pump). At the higher pressures at which torque wrenches are typically operated in the linear tensioning range of a fastener, such pumps are fixed displacement devices.

Figure 3:
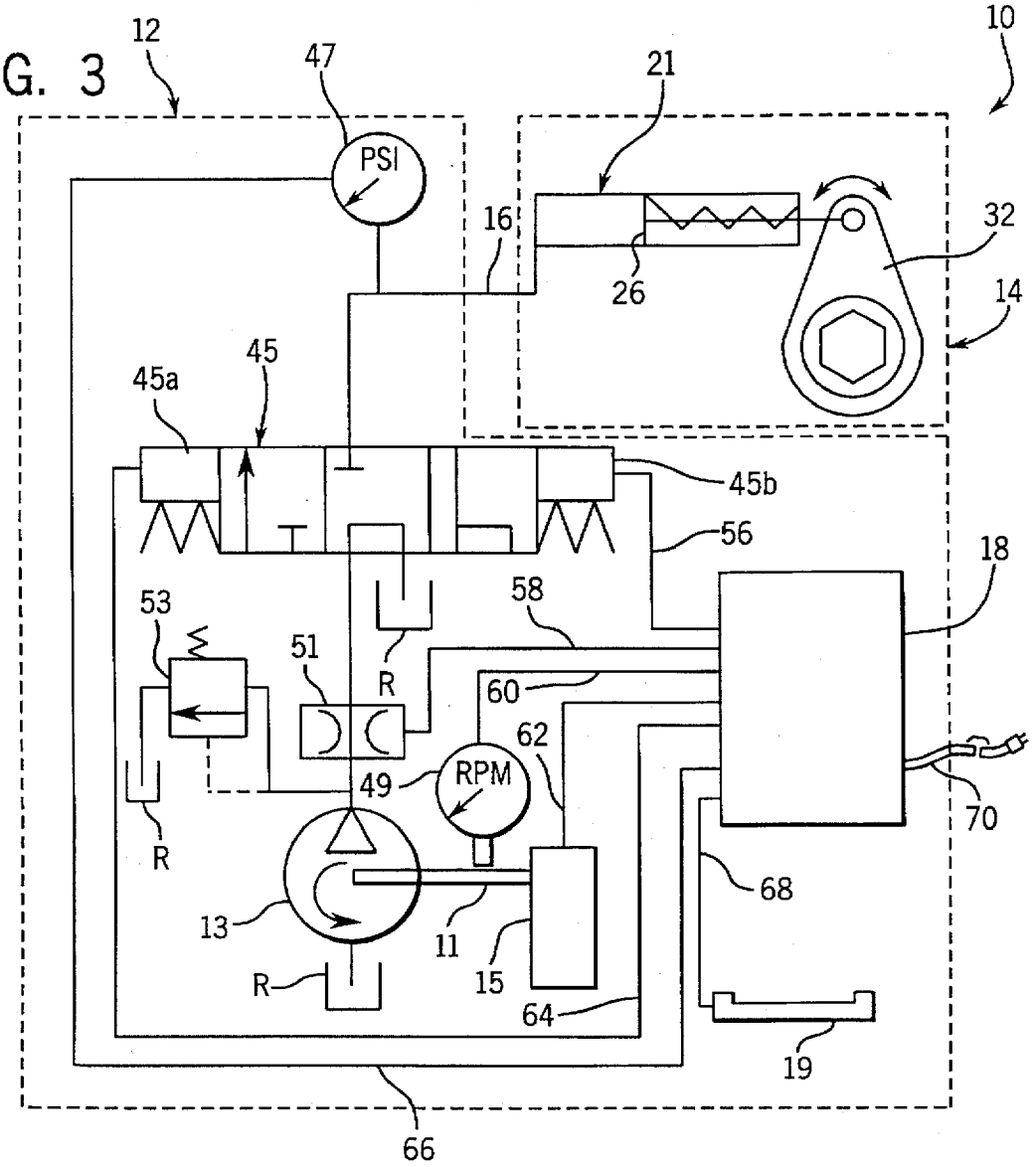
FIG. 3 is an electro-hydraulic schematic diagram of the system of FIG. 1.

FIG. 3 graphically depicts the system 10 in electrohydraulic schematic circuit diagram form. The wrench 14 is schematically illustrated as a ratchet lever 32 and single acting spring return cylinder 21, which is equivalent to the mechanism of FIG. 2. The pumping unit 12 electrohydraulic circuit includes the pump 13, motor 15, a shaft 11 illustrated schematically as connecting the motor 15 to the pump 13 and a reservoir R shown in three places, it being understood that these are one and the same reservoir. The circuit of the unit 12 also includes a three-position, three-way valve 45, a pressure transducer 47, a revolution counter, tachometer or speed transducer 49, a flow rate transducer 51, relief valve 53 and controller 18, and wires 56, 58, 60, 62, 64, 66 and 68 (which may be wire pairs or any number of wires necessary for each component) connecting the various electrical components of the pumping unit 12 to the controller 18. Controller 18 has power cord 70 for plugging into a wall outlet or extension cord for power to the unit 12.

The controller 18 would typically have an on/off switch **18*a*, and may be provided with digital readouts 18*b* and 18*c* of pressure and pump speed, total flow or flow rate. A remote control (not shown) may also be provided for the operator of the wrench 14 to turn the pumping unit 12 on or off without having to walk back to the pumping unit 12 from where he is tightening the threaded fastener. The pressure signal, which is representative of the fluid pressure supplied to the wrench 14 and may be displayed on digital display 18*b*, is processed from the signal generated by transducer 47**.

For a fixed displacement pump, each revolution of the pump drive shaft results in a certain volume of fluid being pumped. Therefore, the pump speed, which would be measured in revolutions per minute, is representative of the flow rate delivered by the pump. Either the pump speed, the flow rate, or any other value representative of them, may be integrated (or added) to yield the total flow delivered over a certain period of time. Either the pump speed, the flow rate, the total flow or the angle of advance may be displayed on digital display 18*c*, as processed from the signal produced by transducer 49 as more fully described below.

If the pump 13 is a fixed displacement device as is preferred, the output signal of the transducer 49 is representative of both speed and flow rate. Furthermore, if the pump 13 is operated at a constant speed, for example by a closed loop speed control system for the pump motor 15 or by a synchronous AC motor, then the flow rate is constant and the total flow delivered is proportional to time. In this case, it would be possible to determine the angle of advance of the wrench 14 from a measurement of time, thereby making the transducers 49 and 51 unnecessary. Thus, a data acquisition system can be employed to sample the data at a known rate. The time variable can be inferred from the number of samples and the sampling rate, to indicate the total flow delivered to the wrench 14 for the relevant portions of the tightening cycle when the fastener is being advanced, as described below.

In the preferred system, in which a pump speed signal is used as representative of flow rate, the transducer 51 is optional and is provided as a check on the output of the transducer 49. The transducer 51 gives a direct measurement of the flow rate, which may be integrated over time to yield flow, to the wrench 14. Alternatively, it may be provided instead of the transducer 49, or if the time measurement approach discussed above is used, neither transducer 49 or 51 may be provided. The transducer 51 may also be used alone, for example if the pump 13 is not a fixed displacement device, to give a signal representative of flow rate.

Since hydraulic fluid is for all practical purposes incompressible, there is a direct relationship between the flow output of the pump 13 which is delivered to the wrench 14 and the angle of advance of the wrench 14. Hence, the output of the transducer 51, which is representative of flow rate, and/or the output of transducer 49, which is also representative of flow rate, determines the rate of advance of the wrench 14. Either output, or any other value representative thereof, can be integrated to determine the angle of advance of the fastener. As noted above, if the pump 13 is driven at a fixed speed, so as to produce a constant rate of advance of the wrench 14, then time (including a count representative of a clock measurement of time) may be integrated over the periods that the fastener is actually being advanced to yield the angle of advance of the fastener.

The relationships between speed, time, pressure and angle for a hydraulic torque wrench are mathematically described as follows:

If $F_W$ is flow to the wrench, $F_P$ is flow from the pump and $F_L$ is leakage flow for the periods that the fastener is being advanced, then $$F_W=F_P-F_L. \tag{1}$$

The pump motor speed S is related to the pump flow $F_P$ as follows:

$$F_P=aS, \tag{2}$$

where "a" is a constant for the specific pump and motor.

The pressure P is related to the leakage flow $F_L$ as follows:

$$F_L=bP, \tag{3}$$

where "b" is a constant for the specific pump.

Combining equations (1), (2) and (3):

$$F_W=aS-bP \tag{4}$$

For hydraulic torque wrenches, the input fluid flow is proportional to the speed of rotation of the wrench socket. That is:

$$F_W=c\ d\theta/dt \tag{5}$$

where "c" is a constant for the wrench, referred to herein as the volumetric rate of angle advance.

If data is sampled at a high rate in comparison to the rate of change of the variables of the system, as would be the case in the preferred embodiment, equation (5) can be very accurately approximated by:

$$F_w=c\ \Delta\theta/\Delta t \tag{6}$$

where $\Delta t$ is the sampling period and $\theta$ is the angle of the socket.

Combining equations (4) and (6) and rearranging yields:

$$\Delta\theta=(aS/c-bP/c)\Delta t \tag{7}$$

The sample period is At and the torque wrench power stroke time ts is broken up into n segments of $\Delta t$ each so that $ts=\Delta t+\Delta t+\Delta t+\Delta t+\ldots\ \Delta t=n\Delta t$. At each sampling instant, data corresponding to speed $S_i$ and pressure $P_i$ is taken and recorded. Thus, for the first time interval:

$$\theta_1\Delta\theta_1=(aS_1/c-bP_1/c)\Delta t \tag{8}$$

In general for any time interval $\Delta t$:

$$\theta_i=\Delta\theta_i=(aS_i/-bP_i/c)\Delta t \tag{9}$$

Finally, the total wrench angle $\theta$ at time $t_1$, time $t_2$ and at any time $t_n$ can be found as follows:

$$\theta(t_1)=\theta_1 \tag{10}$$

$$\theta(t_2)=\theta_1+\theta_2 \tag{11}$$

. . . , so that $$\theta(t_n)=\theta_1+\theta_2+\ldots\ \theta_i+\ldots\ \theta_n \tag{12}$$

Thus, knowing the time variable, the speed variable and the pressure variable provides the angle variable of the torque wrench. As stated above, if the speed is constant, then only the time and pressure variables need to be known to yield angle. Knowing the flow rate dispenses with both of the time and speed variables, but is more problematic to measure. Also, if leakage is relatively small, it can be neglected, so pressure need not be known to yield an accurate determination of angle.

As shown in FIG. 3, in the at-rest position of the solenoid valve 45, flow from the pump 13 is directed to the reservoir and backflow from the wrench 14 is blocked. When solenoid 45*a* is actuated by controller 18, the valve 45 is shifted rightwardly to communicate the entire output of pump 13 to the cylinder 21 of wrench 14, thereby causing piston 26 to advance, or if it has reached its limit of advance (i.e., as far as it will go), causing the pressure in the cylinder 21 to increase sharply, the rate of increase depending on the volumetric stiffness of the hydraulic system, which is typically very stiff.

Since the system is very stiff, when the pressure limit of the relief valve 53 is reached, which is set to be higher than any pressure that might be attained in normal tightening of the fastener during a stroke of the wrench 14, the valve 53 opens to relieve the pressure in cylinder 21 to the reservoir (essentially zero pressure). In this position, output from the pump 13 is also directed to the reservoir. The spring 34 thereby returns the lever 32 to its starting, fully retracted position.

Alternatively, if the relief valve 53 was not provided, the solenoid 45*a* could be de-energized and solenoid 45*b* energized by controller 18, so as to shift the valve 45 leftwardly as viewed in FIG. 3, to relieve the pressure in cylinder 21 to the reservoir and allow the lever 32 to return under the influence of the spring 34.

Figure 6:
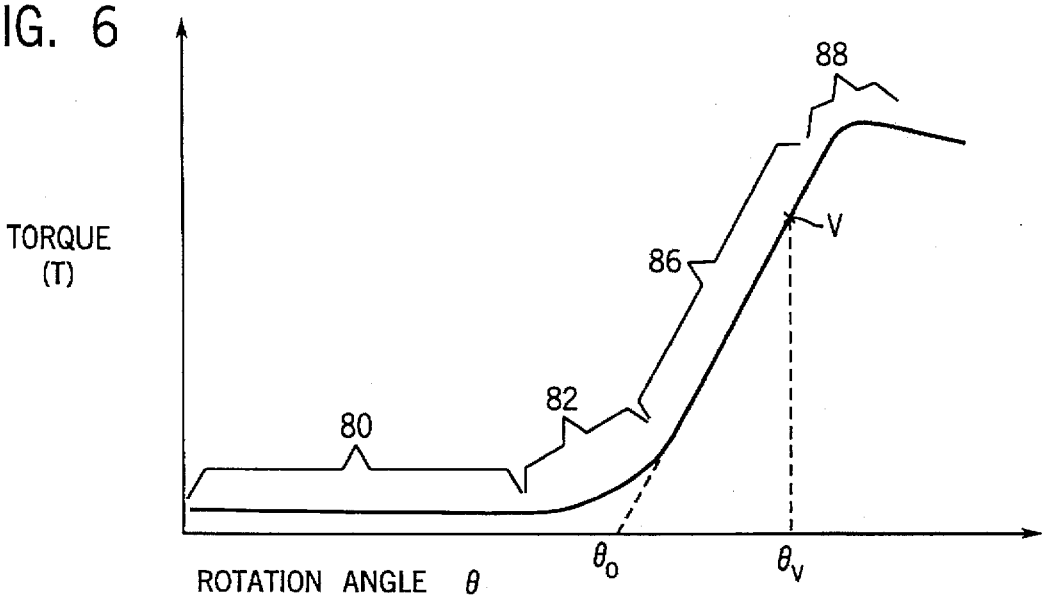
FIG. 6 is a graph of torque versus rotation angle for a typical threaded fastener.
Figure 7:
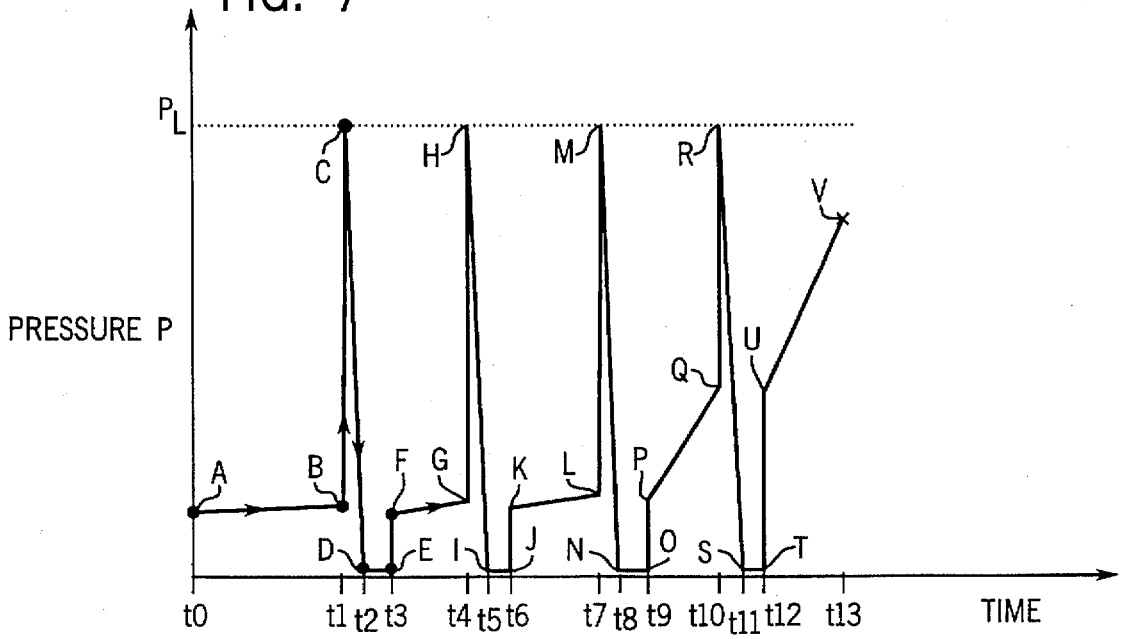
FIG. 7 is a graph of pressure versus time for a hydraulic wrench tightening system.
Figure 8:
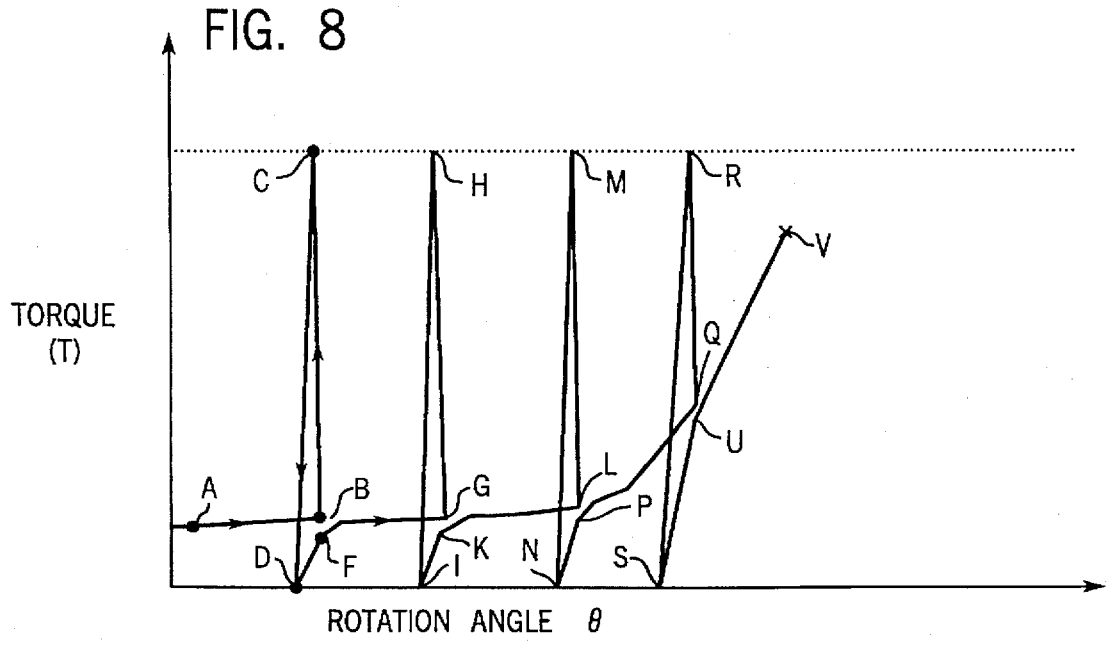
FIG. 8 is a graph of torque versus angle for a hydraulic wrench tightening system.

Controller 18 is programmed to only collect pressure and flow rate data, as measures of torque and rate of angle of advance respectively, during the periods that the fastener is actually advancing in angle. FIG. 6 is an idealized graphical representation of the torque versus angle function for the tightening of a typical fastener. An idealized graphical representation of pressure versus time is shown in FIG. 7 for the tightening system of FIGS. 1 and 3, utilizing a ratcheting type hydraulic torque wrench of the type illustrated in FIG. 2. FIG. 8 illustrates torque (the product of pressure and a constant conversion factor) versus actual measured angle for tightening a fastener with a ratchet type hydraulic torque wrench. Points on the graph of FIG. 8 corresponding to points on the graph of FIG. 7 are identified with the same letters.

The torque-angle curve of FIG. 6 may be viewed in four segments. Segment 80 is a range of initial tightening in which the parts of the joint are brought together without significant clamping and is generally linear and of a low slope. The next portion 82 is the snug or clamp-up range in which the mating threads of the fastener become seated and initially stressed, and the torque angle gradient changes from its previous low value to a significantly higher value which stays substantially constant over the bolt tensioning range 86. Compression of gaskets or other parts of the joint having a significantly lower stiffness than the fastener occurs by the end of portion 82. Beyond the linear bolt tensioning range 86, the non-elastic yield region 88 occurs, in which the fastener or clamped parts of the joint yield plastically. Point "V" represents the desired stopping point for tightening the fastener, which is on the linear part of the torque angle curve, below the yield point of the joint.

The pressure-time curve of FIG. 7 differs dramatically from the torque-angle curve of FIG. 6. However, it is possible to process the pressure-time curve of FIG. 7 to approximate the torque-angle curve of FIG. 6.

To process the pressure versus time data so that the discontinuities are removed and a smooth torque-angle curve is obtained, starting at the beginning of the first stroke, at point A, the pressure and speed data is recorded until the end of the first stroke, at point B. The pressure signal and speed signal are in the form of electrical output signals from the respective pressure 47 and speed 49 transducers, which may be converted (if necessary) by a suitable analog to digital converter in the controller 18 into corresponding digital signals. These signals are converted by the controller into respective torque and angle values, for example, by comparing the digital output values in a look-up chart to determine the corresponding torque and angle values, which can be used to establish a point on the graph of FIG. 8. The flow rate value is first integrated to yield the total flow since the onset of advance, or to yield the incremental flow to the wrench which is added to the previous flow to the wrench, before looking up the corresponding incremental angle value in the look-up chart. The incremental angle value is the angle traversed since the beginning of the present stroke of the wrench 14, which can be added to the angle traversed on the previous strokes to yield the total angle of advance.

Alternatively, the output signals may be mathematically processed to yield corresponding torque and angle values. The conversion of pressure to torque is relatively straightforward mathematically, if the moment arm of the piston 26 acting on the socket 40 is constant, as it may be assumed to be with reasonable accuracy for many hydraulic wrenches. In that case, pressure can be converted to torque by multiplying it by a suitable conversion factor, which is constant, and suitable adjustments made to the value to account for friction (if applicable) and the force due to the compression of spring 34. For example, if spring 34 has a significant spring rate, then part of the pressure force must be attributed to compressing the spring 34 and that part increases as the piston 26 advances and the spring 34 becomes compressed. In that case, the conversion of pressure to torque desirably takes into account the spring force, which varies according to the compression of the spring 34, i.e., according to the incremental angle of advance of the fastener. As stated above, angle may be determined from the speed, time and pressure measurements, using equation (9).

With either the look-up table or the calculation method, calculation times are not significant in comparison with the tightening process time, since tightening with the hydraulic wrench system is a start and stop process with periods in which the fastener is not being turned when the wrench is being reset, which periods provide ample calculation time. The raw data thus obtained (or obtained by using the look-up table approach) may be processed by any desired means to yield a smooth curve or function, for example by a least squares fit smoothing technique.

Referring to FIGS. 7 and 8, angle advance segment A-B of the first stroke, and corresponding segments F-G, K-L, P-Q, and U-V of the subsequent respective second, third, fourth and fifth strokes, represent actual turning of the fastener by the wrench 14. Point B, and corresponding points G, L and Q of subsequent cycles, represent the point in the stroke cycle of the wrench 14 in which the piston 26 is fully extended and bottomed in the cylinder 21, i.e., at this point the wrench 14 is at its limit of advance. Advance of the fastener stops at that point and the result of continuing to pump fluid to the wrench 14 is only to increase the pressure in the cylinder 21 at a high rate.

As stated above, the pressure relief valve 53 opens at a certain pressure limit $P_L$, shown in FIG. 7, which is above any possible normal pressure at the point at which tightening is terminated. When a pressure equal to or greater than the pressure limit $P_L$ is detected, the valve 53 dumps pressure from the cylinder 21 and from the pump 13 to the reservoir, thereby allowing the wrench 14 to reset under the bias of spring 34. In FIG. 7, the pressure limit $P_L$ is reached at point C for the first stroke and at points H, M, and R for the respective second, third, and fourth strokes.

The part of the curve in FIGS. 7 and 8 from points C to D represents the resetting of wrench 14, as does the portions H-I, M-N, and R-S for the respective second, third, and fourth strokes. At points D, I, N and S, the piston 26 has retracted to its fully retracted position, i.e., to its limit of retraction, in which lever 32 is at its zero degree incremental angle starting point. Point D for the first stroke, and points I, N, and S for the respective second, third, and fourth strokes, represent essentially zero pressure, i.e. full resetting of the wrench 14 back to the zero degree incremental angle starting point. This triggers the valve 53 to close, thereby repressurizing the wrench 14. Referring specifically to FIG. 7, the segment from D-E, and the corresponding segments I-J, N-O and S-T, are due to time delay needed to process the data and begin the next stroke.

Ramp segment D-F for the first stroke, and ramp segments I-K, N-P, and S-U, for the respective second, third, and fourth strokes, represent the build-up of pressure in the cylinder 21 without advancing the fastener angle. In going from points B to C to D and then from D to F, a change in angle is illustrated in FIG. 8, negative going from B to C to D and positive going from D to F. However, this is small (e.g., 4°–5°) and only accounts for clearances within the mechanism of the wrench 14 and between the socket and fastener head. The fastener itself does not rotate backwardly or advance significantly during this portion of the cycle.

The data points defining the spike B-C-D and defining the segment D-F are discarded, since they are meaningless to the rotation of the fastener and only represent resetting of the wrench 14. The same is true for the segment G-K, L-P and Q-U for the respective second, third, and fourth strokes of the wrench.

The slope of the segment B-C, and the corresponding segments G-H, L-M, and Q-R for the second, third, and fourth strokes, respectively, is nearly infinity, and therefore is distinguishable from any normal slope of the torque-angle curve. Therefore, the points B, G, L, and Q may be determined during tightening by sensing the onset of this very high slope. For example, a running average calculation of the slope obtained from the data points may be compared to a certain slope maximum, which value is chosen to be above the highest expected slope of the bolt tensioning range of the torque angle curve. When the running average slope becomes greater than the slope maximum, the data begins to be discarded. Alternatively, since point C occurs at essentially the same time as point B due to the incompressibility of hydraulic fluid, the data may begin to be discarded when the pressure limit $P_L$ is detected, or counting back a certain number of data points before then.

From the point B, and the corresponding points G, L and Q of the respective second, third and fourth cycles, the data may continue to be discarded until the pressure at these points is once again obtained, less a correction factor. Thus, point F, where data acquisition restarts, and the corresponding points K, P and U, may be somewhat below their respective corresponding points B, G, L and Q. Part of the difference between the points B and F, between the points G and K, between the points L and P, and between the points Q and U is due to the fact that at the previous point B, G, L, or Q, the spring 34 is fully compressed (since the wrench is at its limit of advance) and at points F, K, P and U the spring is at its least compression (since the wrench is at its limit of retraction). Part of this difference is also due to the socket tightening against the head of the fastener prior to the fastener actually starting to turn. Thus, one may either correct for the difference between the points B and F, and the corresponding other points, by adding an appropriate factor to the point B accounting for the lack of spring compression and the prestressing of the fastener prior to turning, or may use another smoothing technique in this part of the curve, to fit the data points to the relatively flat and straight curve which is expected in this part of the curve. Alternatively, in some applications it may be acceptable to simply restart data acquisition when the pressure is equal to the pressure at which data acquisition last terminated, and join the curve segments with a straight line or use another smoothing technique.

This procedure is applied for each of the strokes of the wrench 14 until the final stopping parameter is obtained, to stop at point V. In the curves shown in FIGS. 7 and 8, this occurs during the fifth stroke prior to reaching the pressure limit $P_L$. The parameters which define the stopping point V may be determined by any desired tightening methodology, preferably one that relies upon values dependent upon both torque and angle, to fully realize the benefits of the invention. The final stopping parameter is obtained by manipulating the data points collected as described above, and when that stopping parameter is obtained, at point V (or slightly before), the controller 18 sends a signal to deenergize solenoid 45*a*, which returns valve 45 to its center position, thereby terminating tightening so that the fastener stops at point V.

One such tightening methodology is described in U.S. Pat. No. 4,106,176. This is a modified turn-of-the-nut methodology in which a fixed angle, empirically determined for the particular joint being fastened, is measured from the zero torque intercept $\theta_0$ (FIG. 6) of the bolt tensioning portion of the torque angle curve. In practicing this methodology in connection with the present invention, torque and angle values for the joint being tightened are determined from the measured pressure and speed data obtained, the bolt tensioning range of the torque angle characteristic curve is extrapolated down to the zero torque axis, and the final stopping angle $\theta_v$ (FIG. 6) (which may be easily converted to a time or flow value) or torque (which may be easily converted to a pressure value) is added to the corresponding value at the zero torque intercept to determine the final stopping parameter, which may be expressed in terms of torque, pressure, angle, time, flow or rotations of the pump shaft, for the period(s) during a stroke of the wrench. The instruction to terminate tightening is then issued by the controller 18 to stop tightening when the final stopping parameter value is reached.

Other methodologies may also be used to practice the invention, such as the yield point method, in which the yield point of the joint is determined based on the measured values indicative of torque and angle and tightening is terminated in response thereto, or turn of the nut as measured from a certain pressure or torque. Other methods utilizing torque and angle values may also be applied in practicing the invention, or the invention may simply be applied to monitor torque and angle parameters during the tightening process, with the operator terminating tightening if they deviate from the expected in the operator's judgement.

Figure 5:
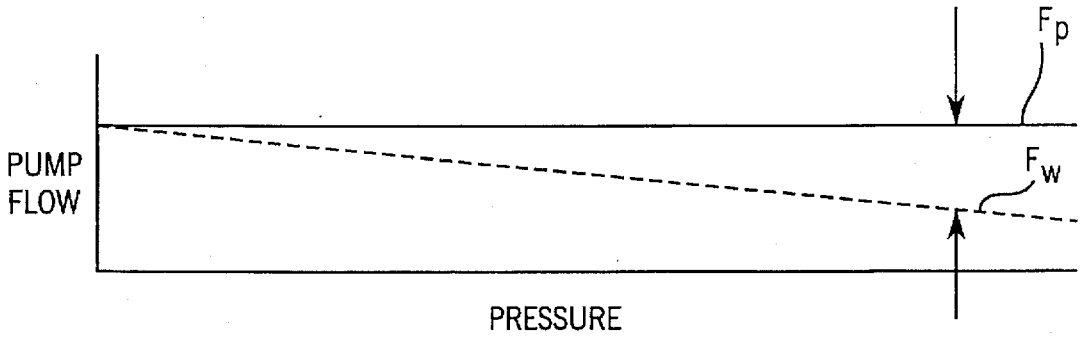
FIG. 5 is a graphical representation of pump flow versus pressure for a typical hydraulic torque wrench system.

There is some leakage in the flow from the pump 12 to the wrench 14, which increases with pressure. Therefore, not all the flow delivered by the pump 12 actually rotates the fastener, a small amount of it being sacrificed to leakage. Leakage increases approximately linearly with pressure, as illustrated in FIG. 5, so a suitable correction factor can be employed if the angle of the fastener is mathematically determined from the pressure and flow rate data (See equation (9)). Alternatively, the angle of advance of the fastener can be determined in a look-up chart relating, for example, pressure and total flow, pressure and the total number of revolutions of the pump 13 or pressure and time, with flow, revolutions or time measured from the start of each stroke of the wrench 14.

Figure 4:
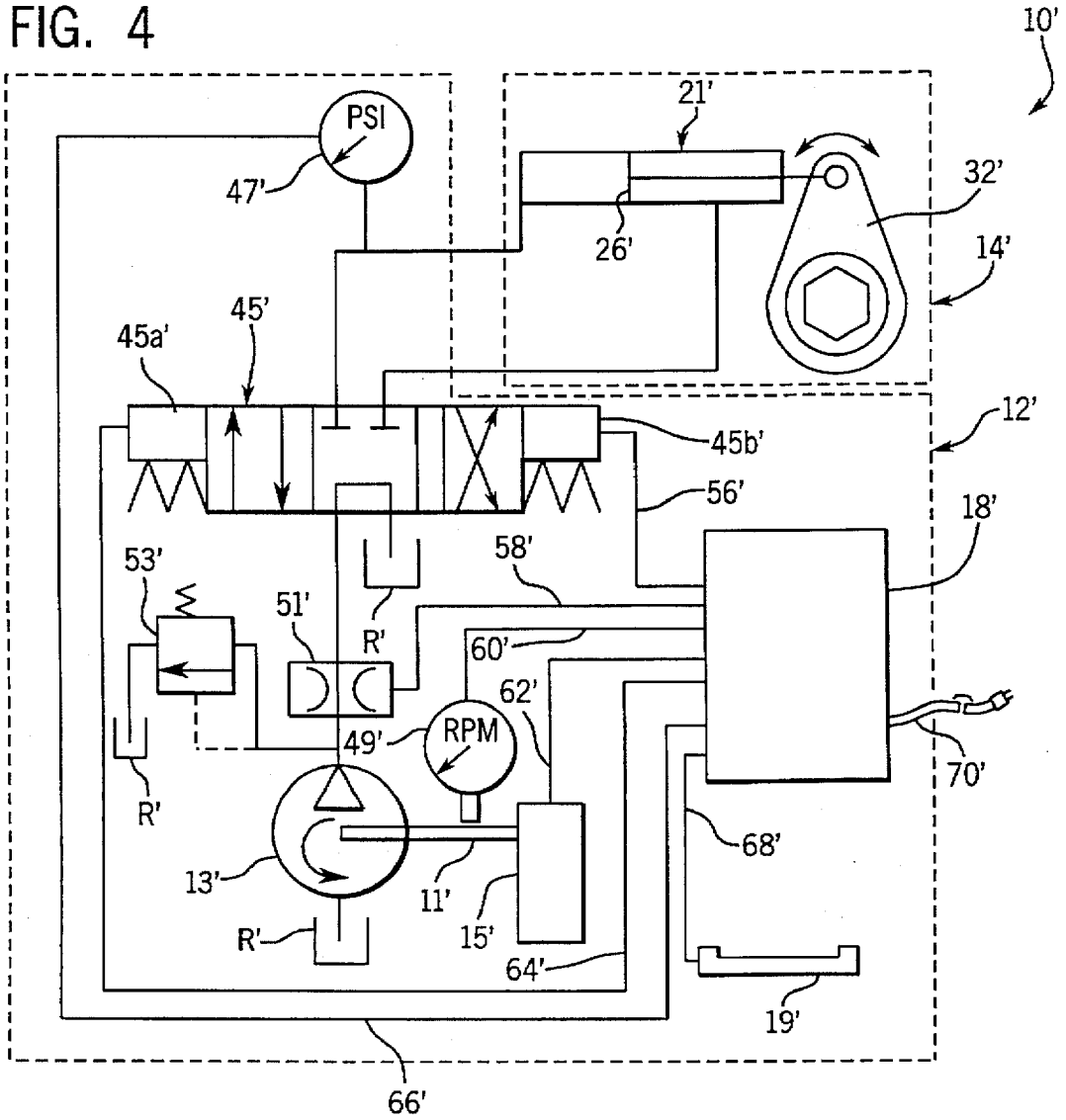
FIG. 4 is a view similar to FIG. 3 but of an alternate embodiment.

An alternate hydraulic schematic for the pumping unit 10 is illustrated in FIG. 4. The circuit of FIG. 4 is substantially identical to that in FIG. 3 and corresponding elements are identified with the same reference number, plus a prime (') sign. The only difference between the wrench 14' and the wrench 14 is that the wrench 14' is not a single acting spring return wrench, but is a double-acting wrench, which is returned by hydraulic pressure, as illustrated in cylinder 21'. Accordingly, the solenoid valve 45' in FIG. 4 is a four-way, rather than three-way, valve, since hydraulic pressure is used to return the wrench to its limit of retraction after each stroke. Thereby, the effects of compressing the spring 34, and the effects which it has on the pressure, are avoided in the embodiment of FIG. 4.

Summarizing with reference to FIG. 7, a signal processing algorithm for practicing the invention is as follows:

1. Starting at A, sample and record the data until the end of stroke B. The end of stroke may be detected by monitoring the pressure limit signal $P_L$, since point C is virtually at the same time as point B. This power stroke covers the time interval from t0 to t1. Multiply the P variable by a correction factor to convert from pressure P to torque T. For a single acting wrench, also subtract out a value attributed to the return spring. No return spring correction is needed for the double acting wrench. This segment is now part of the torque versus time curve. Using equation (9) above, convert the time axis variable (t) into an angle variable (θ) axis.

2. Data from B to D is ignored as this is part of the resetting of the wrench. That is, data from time t1 through t2 is to be discarded.

3. Data from D to E is ignored as this is due to the delay needed to process data and begin the next stroke. That is, data from time t2 through t3 is ignored.

4. At F, the pump begins its next stroke. Data taken from E to F is ignored as this data is due to pump pressure build-up to the prior pressure level. If the points B and F do not quite match in pressure, then average or interpolate the curve at this point to make it smooth.

5. Data from F to G is the next power stroke segment. This is time segment t3 through t4. Treat this segment as in Step 1 above. After the conversion to T versus θ as described in that step, append it to the previous T versus θ segment.

6. Repeat Steps 2 through 5 until the desired stopping point is reached, using any suitable tightening methodology.

Thus, the data from t1-t3, t4-t6, t7-t8 and t10-t12 is discarded and the remaining data from t0-t1, t3-t4, t6-t7, t9-t10 and t12-t13 is put together and converted to torque and angle values to yield a curve which approximates the curve of FIG. 6, up to the stopping point V.

The invention may be practiced with any suitable hydraulic wrench, but it is important to know the characteristics of the particular wrench being used. To this end, an automatic calibration fixture 19 may be provided as part of a pumping unit 12. The wrench 14 being used is hydraulically connected to the pumping unit 12 and then placed on the automatic calibration fixture 19, which has a rotary head 19*a* with which the socket of the wrench 14 is engaged. The head 19*a* is rotated by operating wrench 14, and a rotation sensor 19*b* of the unit 19 measures the rotation of the head 19*a* by the wrench 14. A torque sensor (not shown) may also be employed in the unit 19 to measure the torque exerted on the head 19*a* by the wrench 14. If so, the head 19*a* may be rotated with increasing resistance up to the pressure limit $P_L$, and the measured values of pressure, pump speed, angle of advance and torque can be related in two look-up tables, one relating pressure and angle to torque, and the other relating the integral of pump speed, i.e., revolutions, (or a value representative thereof such as the integral of flow rate, i.e., total flow delivered to the wrench, or time if constant speed) and pressure to angle of advance. Thereby, look-up tables for the torque and angle produced by the wrench 14 as a function of the parameters measured by the pumping unit 12 in operation (i.e., pressure and flow rate or rpm or time) can be automatically generated by the pumping unit 12 for the particular wrench 14.

Alternatively, if the calculation method is used to convert pressure to torque and time to angle, the angle values measured by the fixture 19 and the flow delivered to the wrench 14 to produce the measured advance angle (as determined, for example, from the output of sensor 49 and a measurement of time, See equation (9)) can be used to determine the angle of rotation per unit volume of flow to the wrench (i.e., the volumetric rate of angle advance, c in equation (9)) for the particular wrench being used.

If torque is also measured by the unit 19, the slope of the torque vs. pressure relationship can be determined and applied subsequently to determine torque from the pressure measurements when tightening fasteners. The leakage correction is more a characteristic of the pump and so can be assumed to be constant from wrench to wrench. If a single acting wrench is used, the pressure due to the reaction force of the return spring can also be determined, for example, by shifting valve 45 to its center position at or near the fully extended position of the wrench (with no torque exerted on the socket 19*a*) and measuring the pressure exerted by the spring 34.

Depending upon the operating pressure, some amount of pump flow which does not directly rotate the wrench may be attributable to the elasticity of the hoses and other components and the compressibility of the fluid. If this is significant in the application to which a system of the invention is applied, this should be accounted for and an appropriate correction made. If a look-up table is used to determine the angle values, then no correction would be needed because the correct angle associated with a certain pressure and time, flow or number of revolutions of the pump would be built into the table. Such a table could be automatically generated using the calibration fixture 19. If a calculation method is employed, correction factors can be determined using fixture 19 by running it through two cycles: one being a non-movement cycle where the system measures oil volume due to system component expansion, fluid compressibility and leakage (at one or more operating pressures); and a second cycle, which could be done at low pressure, in which the volume of oil used to extend the wrench for one full cycle is determined. These values can then be used to correct the calculated values for system expansion, fluid compressibility and leakage characteristics.

It is also noted with respect to FIGS. 7 and 8 that in practicing a certain tightening methodology, the portion of the pressure angle curve leading up to point U, and slightly beyond point U, may be irrelevant. If so, all data prior to that point may be discarded, and only data subsequent to that point, determined by setting a certain minimum pressure combined with a slope within the expected range of slopes of the bolt tensioning portion of the torque-angle or pressure-angle curve, need be determined. For example, in the modified turn-of-the-nut methodology referred to above in U.S. Pat. No. 4,106,176, only the linear bolt tensioning range of the curve is of interest, which could be deemed to start at a certain pressure level which is chosen to be above the lowest expected pressure of the bolt tensioning range but below the expected final stopping point.

Many modifications and variations to the preferred embodiment as described will be apparent to those skilled in the art. For example, a system of the invention could be programmed to retract by operating valve 45 or 45' at a certain angle of rotation from the beginning of each stroke so as not to fully extend the wrench piston, which would avoid the pressure spikes and result in quieter operation of the wrench. Also, many diagnostics could be programmed into the system, for example, a warning could be generated if the pressure limit was detected before enough flow had been delivered from the beginning of a stroke to produce a full stroke of the wrench, which would indicate that either the wrench had not fully retracted after the last stroke or that abnormal resistance was being encountered in tightening. Therefore, the invention should not be limited to the embodiment described, but should be defined by the claims which follow.

We claim:

1. An apparatus for tightening a threaded fastener, comprising:

a hydraulically powered wrench;

a source for supplying hydraulic fluid under pressure to drive said wrench;

a reservoir for receiving hydraulic fluid expelled from said wrench;

means for determining an angle parameter including an angular speed transducer for generating a speed signal representative of the angular speed of a pump which supplies said hydraulic fluid to said wrench and a controller for converting said speed signal into said angle parameter, said angle parameter being representative of an angle of rotation of said fastener by said wrench;

means for determining a torque parameter from a measurement of the pressure of hydraulic fluid supplied to said wrench, said torque parameter being representative of a torque applied by said wrench to said fastener; and means for terminating tightening of said fastener based on said torque and angle parameters.

2. An apparatus as claimed in claim 1, wherein said angle parameter determining means includes means for determining the time of flow to said wrench as a measure of the volume of fluid delivered to said wrench.

3. An apparatus as claimed in claim 1, wherein said wrench is of a type driven by a reciprocating piston and cylinder device through a ratchet drive mechanism.

4. An apparatus as claimed in claim 3, wherein said device is single acting.

5. An apparatus as claimed in claim 3, wherein said device is double-acting.

6. An apparatus as claimed in claim 1, wherein said means for terminating tightening of said fastener terminates said tightening when said angle of rotation of said fastener has progressed a certain fixed parameter beyond a point determined from said torque parameter and angle parameter determinations.

7. An apparatus as claimed in claim 6, wherein said certain point is a zero torque intercept of a projection of an approximately linear portion of said torque and angle parameter data and zero torque.

8. An apparatus as claimed in claim 1, wherein said means for terminating said tightening of said fastener includes means for generating pressure and associated angle data points, said data points defining a function which in graphical form of pressure versus angle is defined in part by a series of spikes separated by ramps and angle advances, each spike beginning at a first pressure which occurs just prior to said wrench reaching a limit of advance and having a maxima and minima, each said ramp beginning at said spike minima of the previous spike and continuing to a second pressure approximately equal to said first pressure, and each said corresponding angle advance beginning at said second pressure and continuing to the first pressure of the succeeding spike, said angle advance being a set of data points resulting from turning said fastener.

9. An apparatus as claimed in claim 8, wherein said data points of said spike and of said ramp are discarded.

10. An apparatus as claimed in claim 8, wherein said data points of said angle advances are smoothed to create a characteristic function of parameters representative of torque and angle for said joint.

11. An apparatus for tightening a threaded fastener, comprising:

a hydraulically powered wrench;

a source for supplying hydraulically under pressure to drive said wrench;

a reservoir for receiving hydraulic fluid expelled from said wrench;

means for determining an angle parameter from a measurement of the volume of fluid supplied to said wrench, said angle parameter being representative of an angle of rotation of said fastener by said wrench;

means for determining a torque parameter from a measurement of the pressure of hydraulic fluid supplied to said wrench, said torque parameter being representative of a torque applied by said wrench to said fastener;

means for terminating tightening of said fastener based on said torque and angle parameters; and a calibration fixture having means for determining the volumetric rate of angle advance for a given wrench.

12. A method of tightening a threaded fastener, comprising:

engaging said fastener with a hydraulically powered wrench;

supplying pressurized fluid to said wrench so as to rotate said fastener;

measuring pressure applied to said wrench;

determining a parameter representative of torque applied to said fastener from said pressure measurements;

determining the angle of advance of said fastener corresponding to each said parameter representative of torque from a measurement of angular pump speed; and terminating tightening of said fastener in response to said parameters of torque and corresponding angle.

13. A method as claimed in claim 12, wherein said wrench is a ratchet-type hydraulic wrench.

* * * * *

UNITED STATES PATENT AND TRADEMARK OFFICE

CERTIFICATE OF CORRECTION

Patent No. : 5,668,328

Dated : September 16, 1997

Inventor(s) : George R. Steber, et al.

It is certified that errors appear in the above-identified patent and that said Letters Patent is hereby corrected as shown below:

Col. 6, line 34 (Equation 8), change "$\theta_1\Delta\theta_1=(aS_1/c-bP_1/c)\Delta t$" to --$\theta_1=\Delta\theta_1=(aS_1/c-bP_1/c)\Delta t$--.

Col. 14, line 25 (claim 11) change "hydraulically" to --hydraulic fluid--.

Signed and Sealed this

Thirtieth Day of December, 1997

Bruce Lehman

*Attest:*

BRUCE LEHMAN

*Attesting Officer*

*Commissioner of Patents and Trademarks*